US008720362B2

(12) United States Patent
Nicholas et al.

(10) Patent No.: US 8,720,362 B2
(45) Date of Patent: May 13, 2014

(54) BOAT SEAT MOUNTING ASSEMBLY

(76) Inventors: Brian R. Nicholas, Waukesha, WI (US); Michael T. Plockelman, New Berlin, WI (US)

( * ) Notice: Subject to any disclaimer, the term of this patent is extended or adjusted under 35 U.S.C. 154(b) by 66 days.

(21) Appl. No.: 13/346,680

(22) Filed: Jan. 9, 2012

(65) Prior Publication Data

US 2013/0174772 A1 Jul. 11, 2013

(51) Int. Cl.
*B63B 17/00* (2006.01)

(52) U.S. Cl.
USPC ..... 114/363

(58) Field of Classification Search
USPC ..... 114/363
See application file for complete search history.

(56) References Cited

U.S. PATENT DOCUMENTS

| | | | | |
|---|---|---|---|---|
| 3,718,365 | A | 2/1973 | Gibson | |
| 3,789,444 | A * | 2/1974 | McCord | 114/363 |
| 3,795,927 | A | 3/1974 | Darwin, Jr. et al. | |
| 3,821,825 | A | 7/1974 | Bailey | |
| 4,432,525 | A | 2/1984 | Duvall | |
| 4,700,921 | A | 10/1987 | Holbrook | |
| 4,709,648 | A * | 12/1987 | Andrews | 114/363 |
| 4,729,336 | A | 3/1988 | Rohne | |
| 4,766,838 | A * | 8/1988 | Johnson | 114/363 |
| 4,802,708 | A * | 2/1989 | Vos et al. | 297/252 |
| 5,575,564 | A * | 11/1996 | Harmon et al. | 384/34 |
| 5,590,619 | A * | 1/1997 | Meador et al. | 114/363 |
| 6,733,084 | B2 * | 5/2004 | Butler | 297/452.56 |
| 7,513,211 | B1 * | 4/2009 | Farb et al. | 114/363 |
| 7,980,192 | B2 * | 7/2011 | Flynn | 114/363 |
| 2009/0288588 | A1 * | 11/2009 | Nicholas et al. | 114/363 |
| 2013/0174772 | A1 * | 7/2013 | Nicholas et al. | 114/363 |

OTHER PUBLICATIONS

Action Products Company, Action Products 2008/2009 Catalog, circa 2008, Odessa, MO, USA.

* cited by examiner

*Primary Examiner* — Lars A Olson
*Assistant Examiner* — Jovon Hayes

(57) ABSTRACT

A seat mounting assembly is provided for quick and easy attachment to a transverse bench-style seat of a fishing or Jon-type boat. The seat mounting assembly is quickly and easily attached to the bench-style seat such that the seat mounting assembly allows a seat attached thereto to slide longitudinally to the transverse bench seat. The unique interface of a seat base and a track of the seat mounting assembly helps ensure that the seat attached to the seat mounting assembly will not tip relative to the bench-style seat, while the low profile design of the seat mounting assembly helps keep the center of gravity of a boat to which the seat mounting assembly is installed substantially unchanged.

20 Claims, 6 Drawing Sheets

BOAT SEAT MOUNTING ASSEMBLY

FIELD OF THE INVENTION

The subject invention generally pertains to a seat mounting assembly adapted to be mounted to a transverse bench-style seat of a fishing or Jon-type boat, such that the seat mounting assembly allows a seat attached thereto to slide longitudinally relative to the transverse bench seat and be held in place by the weight of an occupant using the seat such that the seat cannot move relative to the transverse bench.

BACKGROUND OF RELATED ART

Many fishing and Jon-type boats are factory-equipped with backless, bench-style seats that are uncomfortable and are permanently fixed in place, giving the user little flexibility when it comes to seating. Consequently, some fishermen have added more comfortable and functional seats to their fishing boats.

There are a variety of seat clamp assemblies available for attaching a more comfortable, backed fisherman's seat and associated swivel mechanism to a fishing or Jon-type boat. One option is to simply attach the more comfortable fisherman's seat, with or without a swivel-type base, to the existing bench-style seat. While this option provides a more comfortable seat, the seat is fixed relative to the bench-style seat (it cannot slide longitudinally relative to the bench-style seat). It may be desirable to move the attached fisherman's seat longitudinally along the bench-style seat to put the fisherman's seat in a more comfortable position for operating the motor or fishing or hunting on a particular side of the boat.

An alternative to simply attaching a fisherman's seat to a transverse bench-style seat is the seat clamp assembly disclosed in U.S. Pat. No. 3,718,365, which shows a seat attachment assembly that is detachably secured to the sides of a boat, such that the seat rests above the height of the boat. Although such an assembly does offer certain improvements over factory-installed bench seats, it has numerous drawbacks.

First, because the seat rests so high relative to the boat (above the sides of the boat), it raises the center of gravity of the boat, thereby making the boat less stable in the water and more likely to capsize. Second, because the seat attachment assembly is attached to the sides of the boat, there is nothing to support the area under the seat (and the fisherman), creating a potentially hazardous situation should one of the rails or attachment screws fail. There is no structure of any substance for supporting the combined weight of the seat and the fisherman, putting tremendous stress on the rails and attachment screws. Third, the seat attachment assembly is only secured to the sides of the boat via set screws that do not extend into or through the boat itself, leaving opportunity for the screw and seat attachment assembly to slip out of engagement with the boat. Finally, there is no provision for locking the seat base (and attached seat) into place relative to the rails, which means that the seat base (and attached seat) can slide side-to-side while in use if the boat shifts or rocks in the water, thereby creating an unsafe condition.

Another seat clamp assembly is disclosed in U.S. Pat. No. 4,709,648, which shows a seat attachment assembly that includes a single rod on which a seat bracket can both slide and rotate. The single rod is fixedly attached to a lateral face of the factory-installed bench seat, such that when a seat is attached to the seat bracket, the seat can slide along the rod and move longitudinally relative to the bench seat. The rod also serves as an axis of rotation, allowing the seat to be rotated between an operative and an inoperative position. The seat clamp assembly of U.S. Pat. No. 4,709,648 offers limited improvements over factory-installed bench seats, but it also has numerous drawbacks.

First, the back portion of the seat base, or attached seat, is not secured to the boat or bench seat, which means that the seat can flip forward about the rod. If a user is sitting in the seat and the boat stops suddenly or slows quickly, the seat could flip forward and eject the user from the seat—an obviously unsafe, undesirable phenomenon. Second, the seat can swivel, which means that if a user swivels the seat one hundred eighty degrees to face backwards in the boat, the user could flip the seat over by simply leaning backwards in the seat—another unsafe, undesirable occurrence. Third, the seat base rests directly on the top panel of the bench seat such that sliding of the seat base may scrape, scratch, or otherwise damage the top panel of the bench seat. Finally, many transverse bench-style seats do not have front and back panels situated below and perpendicular to the top panel. Many seats are simply a flat, relatively thin member (a piece of wood or metal) extending across the sides of the boat with no structure underneath them. Seat clamp assembly of U.S. Pat. No. 4,709,648 must be attached to a front or back panel and would not work for the many boats with a piece of relatively thin wood or metal as its transverse bench-style seat.

Yet another seat clamp assembly for use with a bench seat of a boat is disclosed in U.S. Pat. No. 4,432,525, which shows a complicated assembly intended to allow an attached seat to move longitudinally along the transverse bench seat. The disclosed seat clamp assembly includes a wheeled carriage, springs, and threaded rods, among other components, making the assembly quite complex and bulky. Because of all the components included in the assembly, a seat attached thereto sits very high relative to the boat, which, when sat on, alters the center of gravity of the boat and makes it more unstable in the water. Furthermore, the large number of parts included in the seat clamp assembly makes it difficult to assemble and increases the likelihood that that the assembly will not function as intended.

A final seat clamp assembly is manufactured by Action Products Company and sold under the trade name "Release-A-Seat" (Model Number 5498 or 5498L). Other companies, such as Wise, Swivl-Eze, and Springfield Marine Company, may also manufacture and distribute a seat clamp assembly that is substantially identical to that sold under the "Release-A-Seat" trade name. Given the substantial identity between this variety of seat clamp assemblies, one of ordinary skill in the art will appreciate that the weaknesses and drawbacks of the "Release-A-Seat," as discussed in the following paragraph, apply to these substantially identical seat clamp assemblies, as well.

As the name implies, a primary goal of the "Release-A-Seat" seat clamp assembly is that the seat base and attached seat be quick and easy to remove from the boat. Because the seat base and attached seat is removed at one of the two ends of the seat clamp assembly, a substantial gap must exist between the two ends of the seat clamp assembly and the two side walls of the boat. As such, the seat clamp assembly cannot span a substantial portion of the space between the boat's side walls, which results in limited travel of the seat base and attached seat. Also, the rear edge of the "Release-A-Seat" seat base directly contacts and slides on the top panel of the bench, and the friction that results from this contact may scratch, scrape, or otherwise damage the top panel. Furthermore, the "Release-A-Seat" provides no means for positively locking the seat base (and attached seat) into place, which means that they can slide side-to-side while in use, if the boat shifts or rocks in the water. Finally, a portion of a front rail hangs over the front edge of the top panel, which forces the seat to be positioned near the front edge of the bench seat, instead of at the center on the bench seat. Of course, the most safe and stable position for an after-market seat is at, or near, the center of the factory-installed bench seat.

Due to the weaknesses and deficiencies inherent with existing seat clamp assemblies, a need exists for a seat clamp assembly that overcomes the limitations and drawbacks of existing systems.

DESCRIPTION OF THE PREFERRED EMBODIMENT

Figure 1:
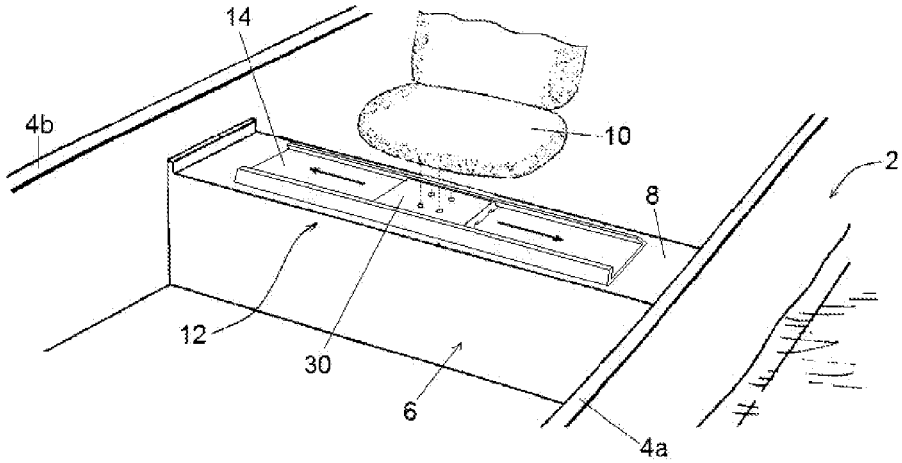
FIG. 1 is a fragmentary perspective view of a typical lightweight fishing or Jon-type boat with a seat mounting assembly operatively installed on one of the transverse, bench-style seats of the boat.
Figure 2:
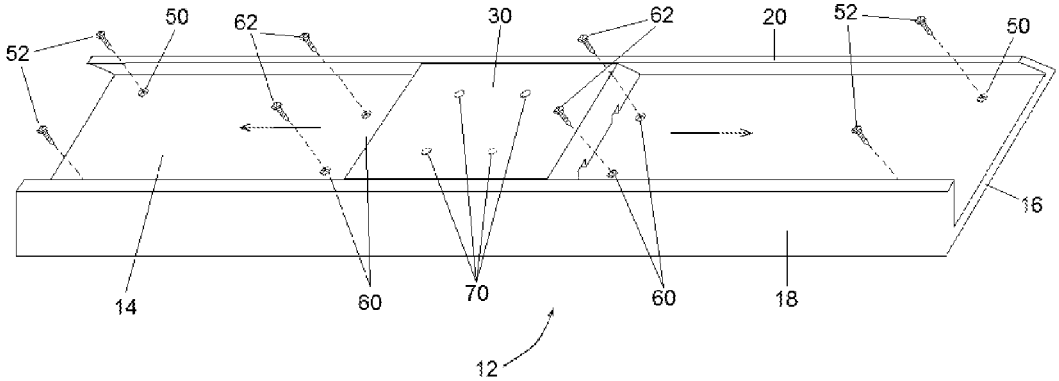
FIG. 2 is a perspective view of the seat mounting assembly.
Figure 3:
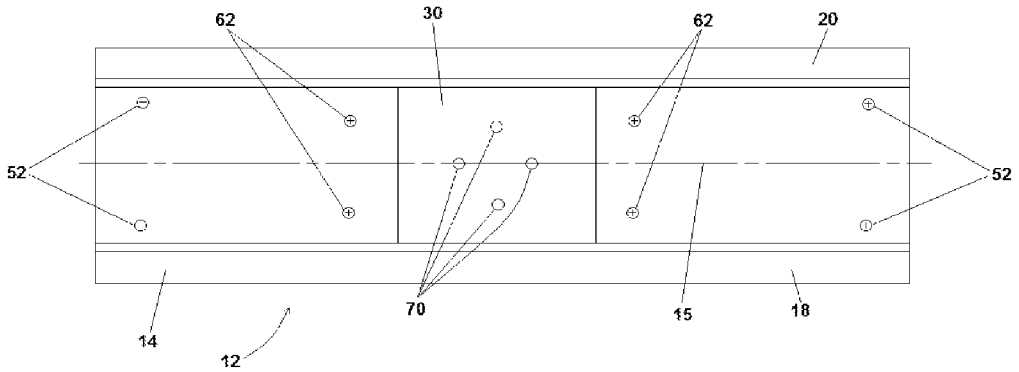
FIG. 3 is a top view of the seat mounting assembly.

FIGS. 1-11 show a seat mounting assembly 12 for use with a fishing or Jon-type boat 2. Seat mounting assembly 12 is adapted to be secured directly to a top panel 8 of a transverse, bench-style seat 6 that is typically factory-installed in boat 2. As shown in FIG. 1, factory-installed, bench-style seat 6 is typically a simple, boxy seat that is functional but uncomfortable, offering little positioning flexibility for boaters.

Seat mounting assembly 12 comprises a track 14 and a seat base 30 that fits into and slides within track 14. Track 14 includes a lower section 16, a first inclined section 18, and a second inclined section 20. First inclined section 18 extends upwardly from lower section 16 at a first acute angle 22, sloping inward toward a centerline 15 of the seat mount assembly, while second inclined section 20 extends upwardly from lower section 16 at a second acute angle 24, sloping inward toward centerline 15. For simplicity and ease of manufacture, it may be desirable for first acute angle 22 and second acute angle 24 to be substantially equal, preferably both acute angles being in the range of forty-five degrees to sixty degrees. Track 14 is preferably made of 12-gauge powder-coated steel for its combination of high strength, reasonably low weight, and good corrosion resistance, although other materials could also be used, such as stainless steel, aluminum, or ultra high molecular weight polyethylene (a UHMW plastic).

Figure 5:
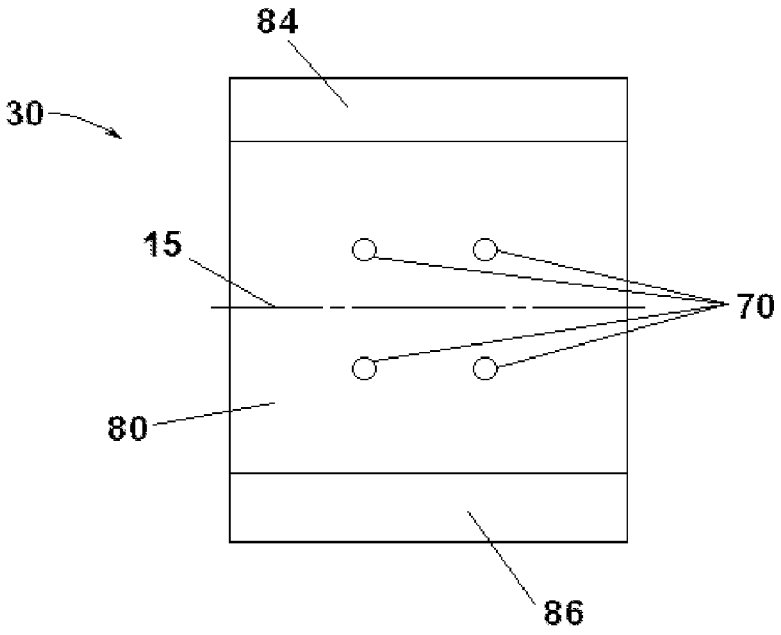
FIG. 5 is a top view of a seat base of the seat mounting assembly.
Figure 6:
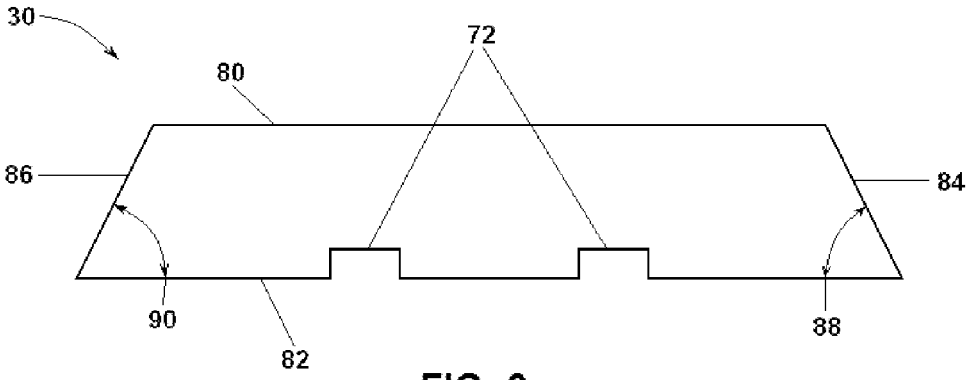
FIG. 6 is an end view of the seat base.
Figure 7:
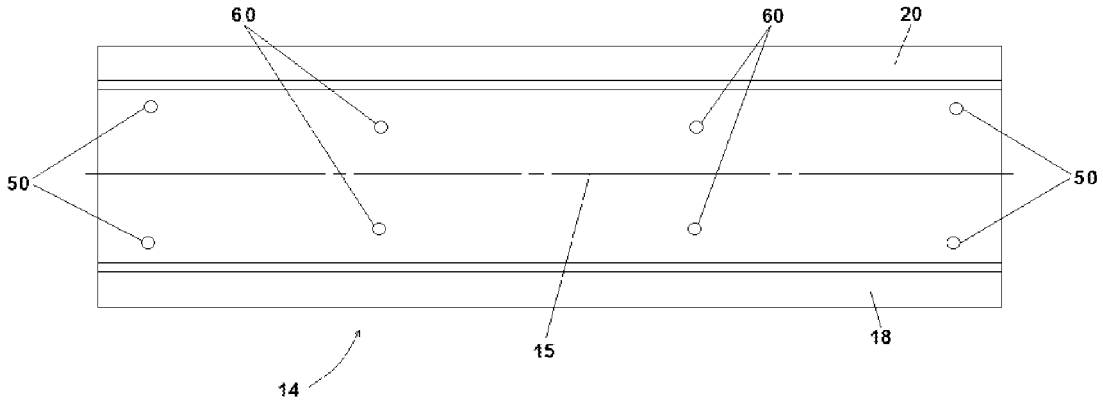
FIG. 7 is a top view of a track of the seat mounting assembly.
Figure 8:
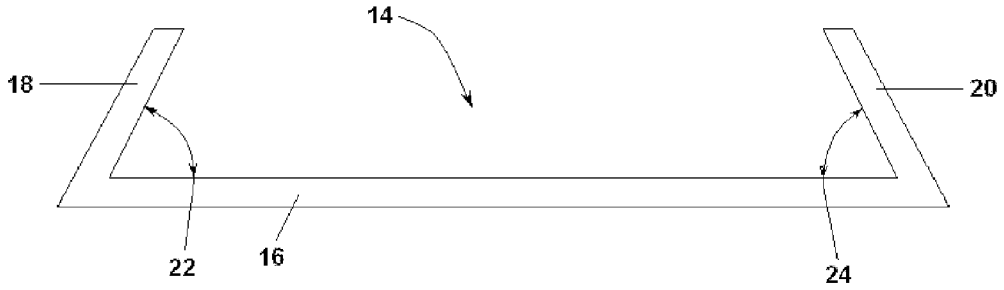
FIG. 8 is an end view of the track.

As shown in FIGS. 5 and 6, seat base 30 is a substantially solid block of material with a trapezoidal cross-sectional geometry. Seat base 30 is preferably made of ultra high molecular weight (UHMW) polyethylene because of its high lubricity and low coefficient of friction, which allow it to slide well within track 14, although other similar plastic materials may be used. Base 30 includes a top surface 80, a bottom surface 82 that is substantially parallel to top surface 80, a first side surface 84, and a second side surface 86. First side surface 84 is disposed at a third acute angle 88 to bottom surface 82, and second side surface 86 is disposed at a fourth acute angle 90 to bottom surface 82, wherein third acute angle 88 is preferably equal to first acute angle 22 and fourth acute angle 90 is preferably substantially equal to second acute angle 24. For simplicity and ease of manufacture, it may be desirable for acute angles 22, 24, 88, and 90 to be substantially equal angles in the range of forty-five degrees to sixty degrees.

The unique geometry of first and second angled side surfaces, 84 and 86, of seat base 30 and corresponding mating first and second inclined sections, 18 and 20, of track 14 prevent base 30 from pulling upward, out of track 14. Because first and second inclined sections, 18 and 20, extend over a portion of seat base 30, seat base 30 will not pull vertically upward out, or tip out, of track 14 (which is securely fastened to top panel 8 of bench-style seat 6), no matter how forces that may tend to tip seat 10 (attached to seat base 30) are applied to the seat.

Figure 4:
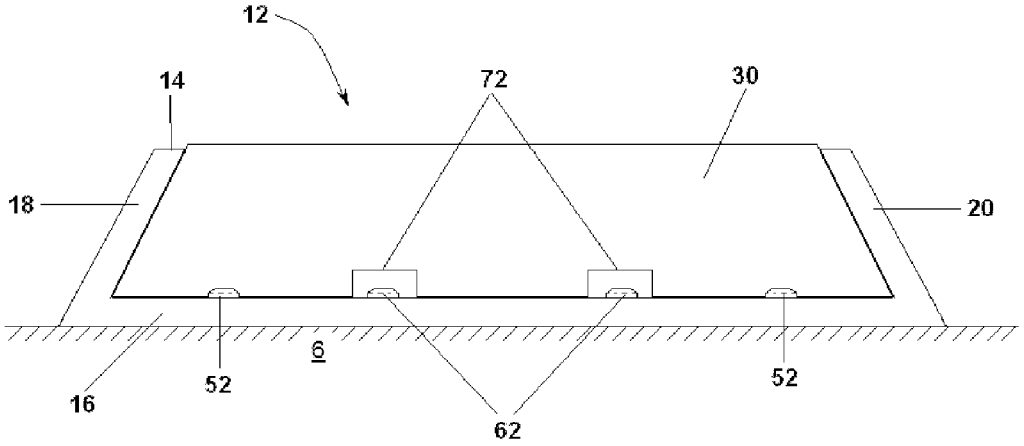
FIG. 4 is an end view of the seat mounting assembly.

FIG. 4 clearly shows the low profile of seat mounting assembly 12. Put differently, seat mounting assembly 12 has a very low height, or thickness, which is advantageous because seat assembly 12 will raise the center of gravity of boat 2, in which the seat mounting assembly is mounted, only very minimally. Seat mounting assembly 12 preferably has an overall height, or thickness, of only approximately seven-eighths of an inch. The low profile of seat mounting assembly 12 enables seat mounting assembly 12 to minimally alter the center of gravity of boat 2, allowing the boat to remain stable and unlikely to capsize.

Track 14 includes a first group of track mounting holes 60 and a second group of track mounting holes 50 for purposes of attaching the track 14 to top panel 8 of bench-style seat 6. With seat mounting assembly positioned on top panel 8, as shown in FIG. 1, a first group of screws 62, which are preferably standard sheet metal screws, is inserted through first set of track mounting holes 60 and driven into top panel 8, and a second set of screws 52, also preferably standard sheet metal screws, is inserted through second group of track mounting holes 50 and driven into top panel 8. Once the first and second sets of screws, 62 and 52, are tightened in place, track 14 will be held securely to top panel 8 such that the track will not move relative to top panel 8. Although example track 14 is preferably attached to boat 2 with screws 52 and 62 because they are easy to use, other types of fasteners could also be used to secure the seat mounting assembly to the boat.

While it may be possible to countersink the track mounting holes to prevent the screws inserted into those holes from impeding the sliding motion of base 30 within track 14, bottom section 16 of track 14 is thin to keep track 14 lightweight and low cost, and countersinking the track mounting holes would drastically reduce the structural integrity of bottom section 16. Accordingly, neither first group of track mounting holes 60 nor the second group of track mounting holes 50 are countersunk. However, in order for seat mounting assembly 12 to function properly, base 30 must be able to slide substantially the entire length of track 14 without obstruction. In order to meet this requirement, base includes slots 72 adapted to be in alignment with first group of track mounting holes 60 and corresponding first group of screws 62. When base 30 passes over screws 62, the screws will fit within slots 72 and will not impede movement of base 30 within track 14, allowing base 30 to slide freely along substantially the entire length of track 14.

In contrast, second group of track mounting holes 50 and corresponding second set of screws 52 are configured to be out of alignment with slots 72 to provide an obstruction to the movement of base 30. In other words, second set of screws 52 acts as a pair of end stops for base 30 within track 14, preventing base 30 from sliding out of track 14. Thus, the hole (and corresponding screw) layout of track 14 and the configuration of slots 72 on base 30 enables base 30 to slide freely along the length of track 14 within the bounds established by second set of screws 52 (inserted into second group of track mounting holes 50).

Because seat mounting assembly 12 is attached to top panel 8 of bench-style seat 6 only by plurality of screws 52 and 62, installation of seat mounting assembly 12 is extremely quick and easy. Most consumers are skilled enough to install several standard machine screws, making installation of seat mounting assembly 12 intuitive and easy. Furthermore, seat mounting assembly 12 may be easily removed, if desired, by simply removing plurality of screws 52 and 62, leaving substantially no damage to the top panel of bench-style seat 6 (only a few small holes).

Track 14 is secured directly to top panel 8 and because seat mounting assembly 12 has a low profile, when installed in boat 2, seat mounting assembly 12 is extremely stable. The combined weight of seat mounting assembly 12, seat 10 (attached to seat mount assembly 12), and an operator sitting on seat 10 will be transmitted substantially directly to bench seat 6. Furthermore, because track 14 is fastened directly to top panel 8 of bench seat 6 (with bottom portion 16 adapted to rest against top panel 8 of seat 6), track 14 will not bend or bow under the combined weight of seat 10 and an operator sitting on seat 10. In addition, direct attachment of track 14 to top panel 8 adds strength to top panel 8 and bench seat 6.

Seat base 30 also includes a plurality of seat mounting holes 70 for purposes of mounting a fishing seat 10 or an intermediate member. It is known in the art to attach fishing seat 10 to a base member via bolts, nuts, or other available fasteners. It is also known in the art to attach intermediate members (members between a base member and a seat) to a base member, wherein those intermediate members can include a swivel base, a quick release mechanism, or a combination thereof. These known intermediate members make traditional fishing seat 10 more useful and are typically attached to a base member via bolts, nuts, or other known fasteners. Seat mounting holes 70 are preferably counterbored or countersunk into bottom surface 82 so that the heads of the fasteners (e.g., bolt heads) are recessed into seat base 30 and do not interfere with movement of base 30 within track 14.

Installation of seat mounting assembly 12 is easy, with an intermediate member (i.e., a swivel base), first being attached to seat base 30 (preferably with stainless steel hardware) and then fishing seat 10 being attached to the swivel base. The assembled seat base/swivel/fishing seat is then inserted into track 14 (with seat base 30 fitting within track 14 as shown in FIGS. 1-4). Seat mounting assembly 12 and the attached swivel/fishing seat 10 are then placed in a desired position on the top panel 8 of bench-style seat 6 and attached thereto via first and second set of screws, 52 and 62, preferably size 14 stainless steel sheet metal screws. It may also be desirable to pre-drill pilot holes (1/16" in diameter) into top panel 8. After these few, simple steps, seat mounting assembly 12 and swivel/fishing seat 10 are ready to use.

Figure 9:
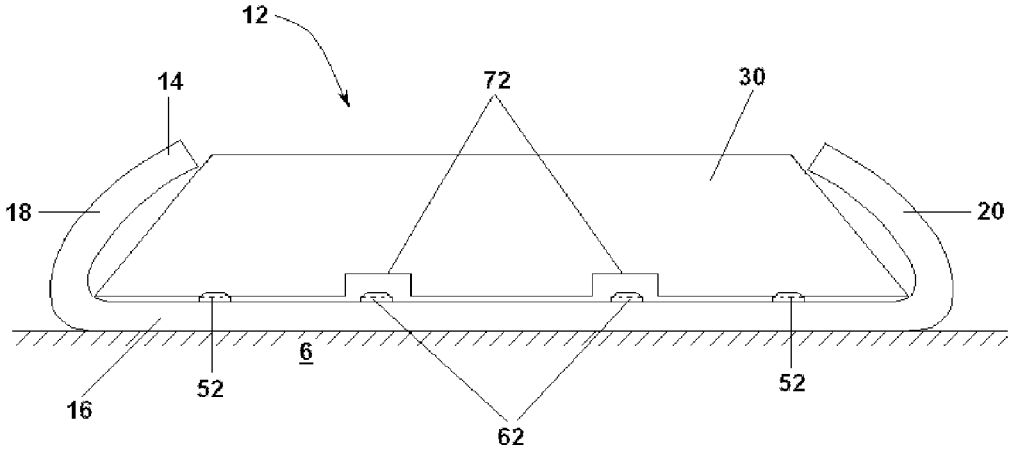
FIG. 9 is an end view of the seat mount assembly showing a track with a different geometry.

Once installed, a user can slide seat 10 to various locations along bench-style seat 6, positioning the seat 10 where most comfortable or desirable for his particular needs. The user's weight is sufficient to hold seat base 30 in place, preventing base 30 from sliding within track 14 when the user is sitting in seat 10 attached to seat base 30, thereby eliminating the need for additional clamps or fasteners. To move seat base 30, the user must simply stand up (fully or partially) to remove his weight from seat 10 and allow seat base 30 (and seat 10 attached thereto) to slide freely within track 14. This effect may be enhanced if first and second inclined sections, 18 and 20, are curved inward toward centerline 15, as shown in FIG. 9. In practice, with both inclined sections 18 and 20 being curved and seat base 30 having all straight surfaces, seat base 30 seems to float above lower section 16 when the user's weight is not applied to seat 10. When the user applies his weight to seat 10 (i.e., sits on it), seat base 30 bottoms out on lower section 16, and the friction therebetween prevents seat base 30 from moving within track 14.

Figure 10:
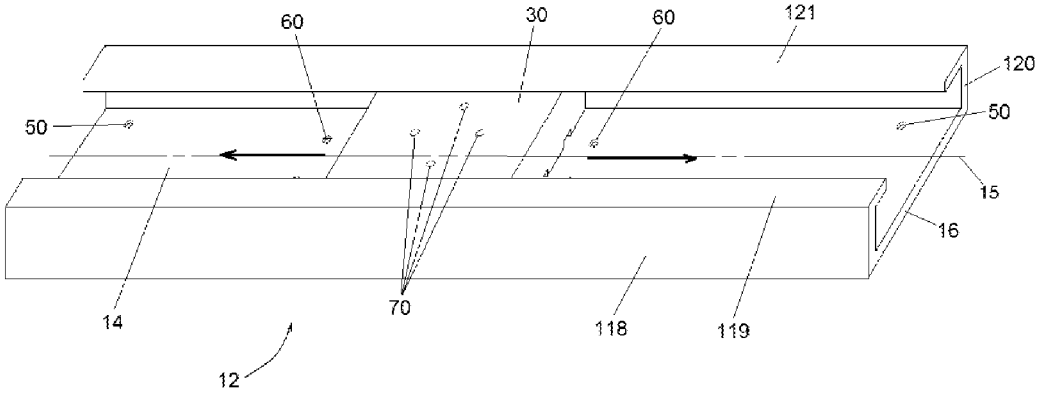
FIG. 10 is a perspective view of another example of the seat mount assembly.

FIG. 10 shows another example seat mounting assembly 12, also comprising a track 14 and a seat base 30 that fits into and slides within track 14. The primary differences between the seat mounting assembly of FIGS. 1-9 and the seat mounting assembly of FIG. 10 are the shapes of the track and the seat base. Track 14 of FIG. 10 is a substantially C-shaped track, with a lower a lower section 16, a first vertically extending section 118, a second vertically extending section 120, and two inwardly extending sections 119 and 121, which extend in from sections 118 and 120, respectively, toward centerline 15. In the example of FIG. 10, seat base 30 is a substantially solid block of material shaped as a rectangular prism. Seat base 30 fits into and slides within track 14, with inwardly extending sections 119 and 121 of track 14 extending over a portion of seat base 30 to prevent base 30 from pulling upward, out of track 14. No matter how forces that may tend to tip seat 10 (attached to seat base 30) are applied to the seat, base 30 will not pull vertically upward out, or tip out, of track 14, which is securely fastened to top panel 8 of bench-style seat 6. The seat mounting assembly of FIG. 10 is mounted and operated in substantially the same manner as described above in connection with the seat mounting assembly of FIGS. 1-9.

Figure 11:
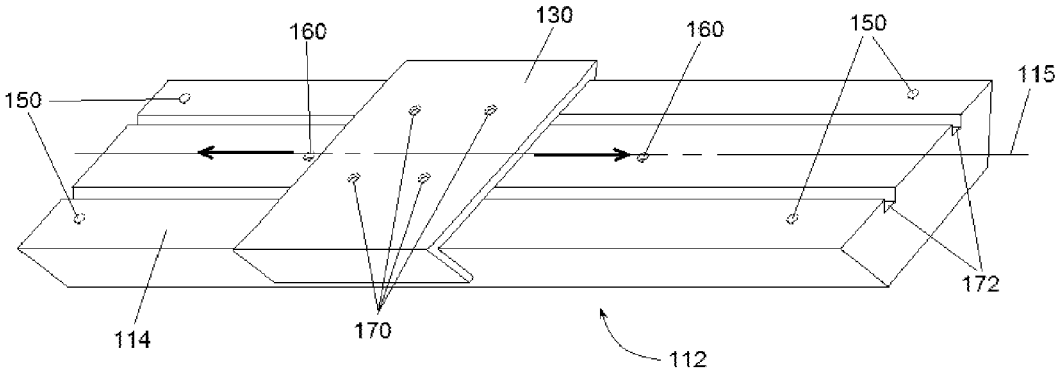
FIG. 11 is a perspective view of yet another example of the seat mount assembly.

FIG. 11 shows yet another example seat mounting assembly 112, this seat mounting assembly representing substantially the inverse of the seat mounting assemblies shown in FIGS. 1-10, with track 114 comprising an elongate, substantially solid block of material (preferably UHMW plastic) and seat base 130 comprising a smaller, relatively thin-walled, formed piece (preferably powder coated steel). Elongate track 114 has a trapezoidal cross-sectional geometry, narrower at the bottom than it is at the top. Seat base 130 has a top section adapted to be attached to a seat 10 or an intermediate member (neither shown in this Figure), and two side sections extending downwardly from the top section and inwardly toward a centerline 115. Seat base 130 is adapted to fit onto and slide along track 114, with the trapezoidal cross-section of track 114 and inwardly extending sections of seat base 130 helping to ensure that seat base 130 will not pull vertically upward off, or tip out, of track 114, which is securely fastened to top panel 8 of bench-style seat 6. In the example of FIG. 11, slots 172 in track 114 are adapted to align with seat base holes 170 so that the heads of any fasteners (e.g., screws, bolts) inserted through holes 170 for securing a seat (or an intermediate member) to seat base 130 will not impede the smooth sliding of seat base 130 along track 114. Similarly, first set of mounting holes 160, for securing track 114 to a bench-style seat may include a countersink or a counterbore to prevent fasteners inserted into holes 160 from impeding movement of seat base 130 along track 114. In contrast, second set of mounting holes 150 may be straight holes, with no countersink or counterbore, so that fasteners (or the heads thereof) inserted into holes 150 may impede movement of seat base 130 along track 114, thereby defining a range of movement for seat base 130 and acting as a pair of end stops.

Although the invention is described with respect to the above described example, modifications thereto will be apparent to those of ordinary skill in the art. The scope of the invention, therefore, is to be determined by reference to the following claims:

The invention claimed is:

1. A seat mounting assembly for use with a boat having a bench seat that spans a portion of a space that exists between a pair of side walls, wherein the bench seat includes a top panel, the seat mounting assembly comprising:

a track attachable to the top panel, the track including a lower section to contact the top panel, a first section extending upwardly from the lower section and having at least a portion that extends inward toward a centerline of the track, and a second section spaced apart from the first section and extending upwardly from the lower section and having at least a portion that extends inward toward the centerline; and a seat base slidingly engaged within the track such that the inwardly extending portions of the first and second sections of the track extend over a portion of the seat base to prevent the seat base from moving out of the track in an upward direction;

wherein the seat base includes a bottom surface engaging the lower section of the track and a first side surface extending upwardly therefrom at an acute angle to the bottom surface.

2. The seat mounting assembly of claim 1, wherein the first section of the track extends upwardly from the lower section at a first acute angle to the lower section.

3. The seat mounting assembly of claim 2, wherein the second section of the track extends upwardly at a second acute angle to the lower section.

4. The seat mounting assembly of claim 3, wherein the first acute angle is substantially equal to the second acute angle.

5. The seat mounting assembly of claim 1, wherein the track further comprises a first mounting hole and a second mounting hole and the seat base further comprises a slot formed in a bottom surface thereof, wherein the first mounting hole is positioned to be in alignment with the slot and the second mounting hole is positioned to be out of alignment with the slot as the seat base slides within the track.

6. A seat mounting assembly for use with a boat having a bench seat that spans a portion of a space that exists between a pair of side walls, wherein the bench seat includes a top panel, the seat mounting assembly comprising:

a track attachable to the top panel, the track including a lower section to contact the top panel, a first inclined section extending upwardly from the lower section at a first acute angle, and a second section spaced apart from the first inclined section and extending upwardly from the lower section; and a seat base slidingly engaged within the track such that the first inclined section extends over a portion of the seat base to impede movement of the seat base in an upward direction;

wherein the second section extends upwardly from the lower section at a second acute angle such that the second section will extend over a portion of the seat base to impede movement of the seat base in the upward direction.

7. The seat mounting assembly of claim 6, wherein the first acute angle is substantially equal to the second acute angle.

8. The seat mounting assembly of claim 6, wherein the seat base includes a bottom surface and a first side surface extending upwardly from the bottom surface at a third acute angle to the bottom surface.

9. The seat mounting assembly of claim 8, wherein the seat base further includes a second side surface extending upwardly from the bottom surface at a fourth acute angle thereto.

10. The seat mounting assembly of claim 6, wherein the seat base further includes a slot formed in a bottom surface thereof.

11. The seat mounting assembly of claim 10, wherein the track further comprises a first mounting hole and a second mounting hole, the first mounting hole disposed to be in alignment with the slot as the seat base slides within the track and the second mounting hole being positioned to be out of alignment with the slot as the seat base slides within the track.

12. The seat mounting assembly of claim 11, further comprising a plurality of fasteners adapted to be inserted into the mounting holes for securing the track to the top panel.

13. A seat mounting assembly for use with a boat having a bench seat that spans a portion of a space that exists between a pair of side walls, wherein the bench seat includes a top panel, the seat mounting assembly comprising:

a track attachable to the top panel, the track comprising a lower section to contact the top panel, a first section extending upwardly from the lower section, a second section spaced apart from the first section and extending upwardly from the lower section, and first and second mounting holes to attach the track to the top panel; and a seat base slidingly engaged within the track, the seat base comprising a slot formed in a bottom surface thereof and oriented such that the slot will be in alignment with the first mounting hole when the seat base slides within the track and out of alignment with the second mounting hole when the seat base slides within the track;

wherein the first and second sections of the track each include a portion that extends inward toward a centerline of the track such that the inwardly extending portions extend over a portion of the seat base when the seat base is within the track to present the seat base from moving out of the track in an upward direction.

14. The seat mounting assembly of claim 13, wherein the first section of the track extends upwardly from the lower section at a first acute angle to the lower section.

15. The seat mounting assembly of claim 14, wherein the second section of the track extends upwardly at a second acute angle to the lower section.

16. The seat mounting assembly of claim 15, wherein the first acute angle is substantially equal to the second acute angle.

17. The seat mounting assembly of claim 13, wherein the seat base includes a bottom surface and a first side surface extending upwardly therefrom at a third acute angle to the bottom surface.

18. The seat mounting assembly of claim 1, wherein the first section of the track has a curved portion.

19. The seat mounting assembly of claim 6, wherein the first and section sections of the track each have a curved portion.

20. The seat mounting assembly of claim 13, wherein the first section of the track has a curved portion.

* * * * *